US007900981B2

(12) United States Patent
Hirschoff

(10) Patent No.: US 7,900,981 B2
(45) Date of Patent: Mar. 8, 2011

(54) DOOR OPENER SYSTEM AND ADAPTER PART FOR USE IN A DOOR OPENER

(75) Inventor: Oliver Hirschoff, Messstetten (DE)

(73) Assignee: Assa Abloy Sicherheitstechnik GmbH, Albstadt (DE)

( * ) Notice: Subject to any disclaimer, the term of this patent is extended or adjusted under 35 U.S.C. 154(b) by 0 days.

(21) Appl. No.: 11/544,939

(22) Filed: Oct. 10, 2006

(65) Prior Publication Data

US 2007/0085354 A1 Apr. 19, 2007

(30) Foreign Application Priority Data

Oct. 11, 2005 (DE) ..... 10 2005 048 693

(51) Int. Cl.
*E05B 15/02* (2006.01)
*E05B 15/00* (2006.01)

(52) U.S. Cl. ..... 292/341.16; 292/340; 292/341.17

(58) Field of Classification Search ..... 292/341.16, 292/340, 341.17, 251.5, DIG. 65, DIG. 51, 292/346, 280, 341.15; 49/280
See application file for complete search history.

(56) References Cited

U.S. PATENT DOCUMENTS

| | | | | |
|---|---|---|---|---|
| 2,683,054 | A * | 7/1954 | Earman | 292/340 |
| 3,159,416 | A * | 12/1964 | Schlage | 292/340 |
| 3,211,850 | A * | 10/1965 | Toepfer | 200/61.64 |
| 3,251,619 | A * | 5/1966 | Schlage | 292/341.18 |
| 4,471,983 | A * | 9/1984 | Bischoff et al. | 292/341.16 |
| 4,626,010 | A * | 12/1986 | Hanchett et al. | 292/341.16 |
| 4,867,496 | A * | 9/1989 | Thomas | 292/341.16 |
| 6,159,416 | A * | 12/2000 | Kawakami et al. | 264/531 |
| 6,251,619 | B1 * | 6/2001 | Van Dreden | 435/13 |
| 6,595,563 | B2 * | 7/2003 | Kiernan | 292/341.16 |
| 6,634,685 | B2 * | 10/2003 | Herron et al. | 292/341.16 |
| 2004/0061343 | A1 * | 4/2004 | Bashford | 292/341.16 |

FOREIGN PATENT DOCUMENTS

| | | | |
|---|---|---|---|
| DE | 66 08 192 | U | 7/1971 |
| DE | 79 11 713 | U1 | 7/1979 |
| DE | 38 01 672 | A1 | 8/1989 |
| DE | 196 31 451 | A1 | 2/1998 |
| DE | 19631451 | A1 | 2/1998 |
| DE | 200 05 387 | U1 | 6/2000 |
| DE | 102 15 014 | A1 | 10/2003 |
| DE | 10215014 | A1 | 10/2003 |
| DE | 103 10 403 | A1 | 9/2004 |
| DE | 10310403 | A1 | 9/2004 |
| DE | 10 2004 012 112 | B3 | 8/2005 |
| DE | 102004012112 | B3 | 8/2005 |
| DE | 10 2004 022 824 | A1 | 12/2005 |
| EP | 1574640 | A2 * | 9/2005 |

* cited by examiner

*Primary Examiner* — Carlos Lugo
*Assistant Examiner* — Alyson M Merlino
(74) *Attorney, Agent, or Firm* — Wood, Herron & Evans, LLP

(57) ABSTRACT

The present invention relates to a door opener system having a door opener, which comprises a pivot latch pivotable into the door opener having a stop, having a striker plate, and having a lock latch guide running diagonally inward into the door opener for guiding the lock latch, an adapter part being provided, on which the lock latch guide is implemented and which is situated between the door opener and the striker plate. In order to obtain a flexibly usable and simultaneously reliably functioning door opener system, the lock latch guide is implemented as a slide face, which runs continuously over the stop width and is situated on the door side next to the stop of the pivot latch and adjoining thereto.

13 Claims, 10 Drawing Sheets

Figure 1:
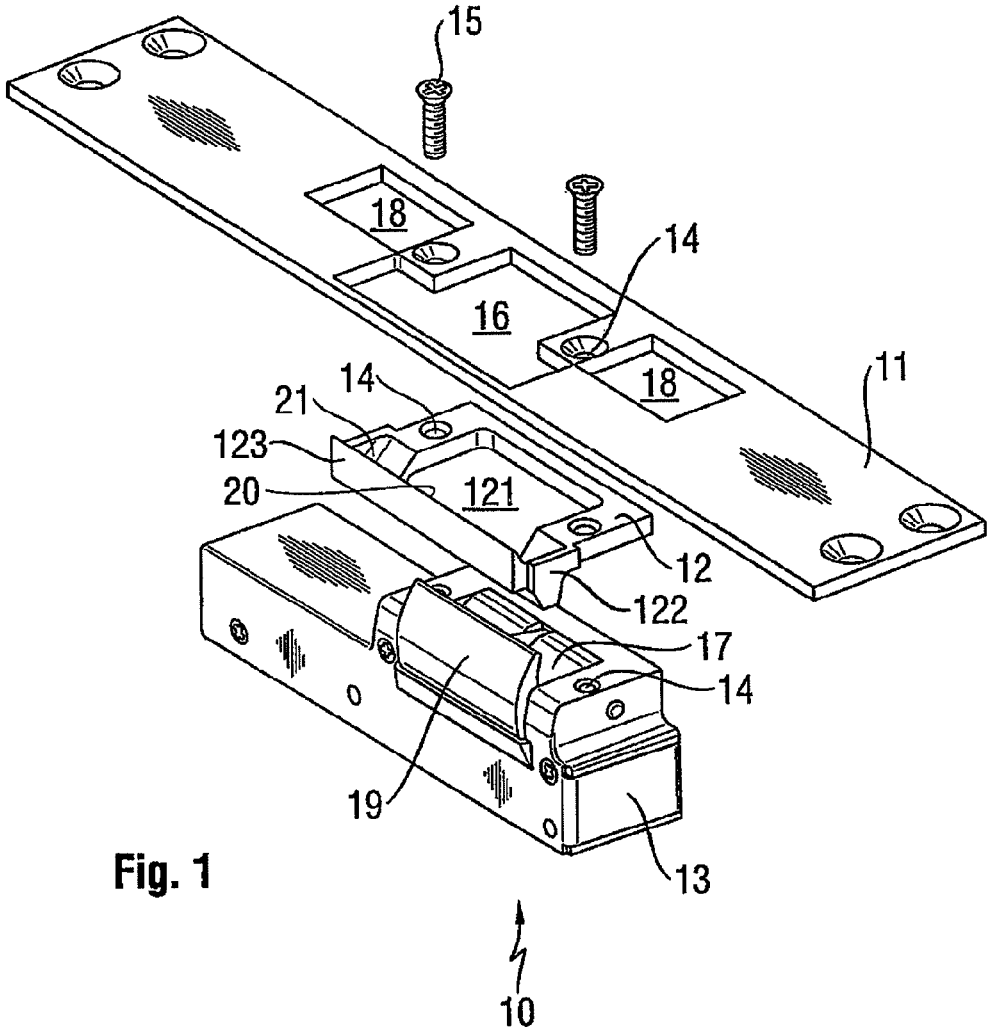

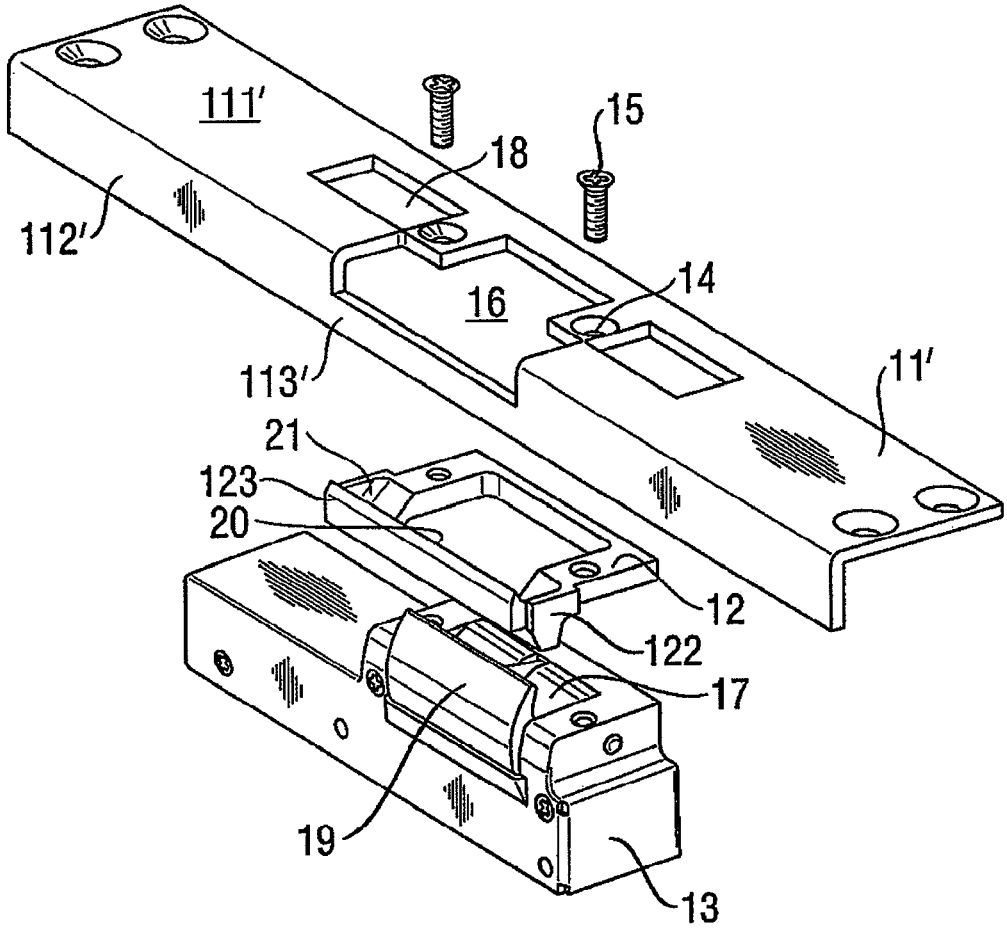
Fig. 2
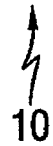

10

DOOR OPENER SYSTEM AND ADAPTER PART FOR USE IN A DOOR OPENER

CROSS-REFERENCE TO RELATED APPLICATIONS

This application claims priority of German Patent Application No. 10 2005 048 693.2, filed Oct. 11, 2005, the entire contents of which are incorporated herein by reference.

The present invention relates to a door opener system having a door opener, which comprises a pivot latch, which is pivotable into the door opener, having a stop. Pivot latches of this type which are pivotable into the door opener are also referred to as radius latches. A stop is attached to this latch, which is implemented to engage behind a lock latch. The stop may be fixed in place or adjustable in the transverse direction to the door opener system. If a fixed stop is provided, the latch is expediently implemented in one piece with the stop. The stop typically runs over the entire latch width from one side of the latch to the other. Furthermore, the door opener system comprises a striker plate and a lock latch guide for guiding the lock latch, which runs diagonally inward into the door opener. The lock latch guide is implemented on an adapter part which is situated between the door opener and the striker plate. Furthermore, the present invention relates to an adapter part for use in door opener systems having a door opener and a striker plate.

Door openers having pivot latches have been known for some time. A lock latch typically engages in the pivot latch in the locked state and is held there using a stop. In the released state, the pivot latch is pivotable against a spring force and may thus release the lock latch. The pivot latch is released electrically and is triggered by a person, for example, via buttons, or automatically, for example, by access control systems.

Because the pivot latch is implemented as a radius latch, i.e., is pivotable into the door opener, less space is required for pivoting. The stop may be implemented as adjustable in order to compensate for inaccuracies during mounting without having to offset the entire door opener system.

In practice, it has been shown that the lock latch, after being released by pivoting the pivot latch, frequently stops on the interior of the door opening housing cover or on an inner edge of a latch opening in the striker plate, through which the pivot latch penetrates to engage in the door opener, and may not be pivoted beyond it. In some circumstances, it may even happen, for example, in the case of a reset stop, that the pivot latch pivots back into its starting position after being released and the lock latch is jammed between the inner edge of the door opening housing cover or the inner edge of the latch opening and the exterior of the stop of the pivot latch and stuck there.

To solve this problem, door openers have been provided with a lock latch guide, which normally run from the striker plate surface diagonally inward into the door opener. The lock latch stops on the lock latch guide after the door opener is released and is pressed inward against a spring force into the door or the door lock because of the bevel of the lock latch guide. The lock latch thus slides along the lock latch guide until it is finally at frame height and is then released.

The known lock latch guides are implemented as slide webs, which run through an opening or recess in the stop. This has the disadvantage that specially shaped stops must be produced for the pivot latches which are tailored to the shape of the particular slide webs used. This has a disadvantageous effect on warehousing. Furthermore, retrofitting already existing door opening systems is thus made complex, since frequently the entire pivot latch including with the stop must be replaced.

The known lock latch guides are frequently implemented as tongues angled away from the striker plate and projecting into the door opener interior. This is disadvantageous since specially implemented striker plates must be produced and kept ready for this purpose. A striker strip having a door opener, in which an adapter part is situated between door opener and striker strip, in which a slide web is implemented for guiding a lock latch, is known from DE 103 10 403 A1. I.e., the striker strip system is provided in a modular construction. The door opener, the striker strip, and the adapter part having slide web are separate system components which are assembled to form the striker strip system. It is advantageous in this case that the adapter part is a separate component and no specially formed striker plates having slide webs of different sizes must be produced. However, the disadvantage also exists here that the latch and/or its stop must be provided with recesses for the slide web(s). Furthermore, a special striker strip system must be manufactured for every mounting position (e.g., frame-side left or right or "offset left", "centerline", or "offset right" (for door openers to be installed in the USA)).

Therefore, it is the object of the present invention to specify a door opener system of the type cited at the beginning in which the lock latch does not remain hanging or hook on the striker plate or on the door opener housing when the door opener is opened and is usable for all common door opener systems and may thus be employed flexibly.

This object is achieved in that the lock latch guide is implemented as a slide face which runs continuously over the entire width of the stop. Furthermore, the lock latch guide is situated on the door side next to the stop of the pivot latch and adjoining thereto.

The basic idea of the present invention is thus not to provide the lock latch guide as a web, but rather as a uniform, consistent slide face or slanted plane which extends at least over the width of the stop of the pivot latch. Furthermore, the lock latch guide does not run through the stop, but rather is situated next to the stop and adjoining it, so that when the pivot latch is pivoted, contact of the lock latch on the lock latch guide is provided directly after the lock latch is released. The lock latch guide is expediently oriented running essentially parallel to the stop. The lock latch guide adjoins the stop from the door side, i.e., from the side from which the lock latch is inserted into the door opener.

It is advantageous in this case that the lock latch guide no longer runs into the interior of the door opener, but rather only adjoins the stop. A special embodiment of the stop (implementation of recesses or openings in the stop) is no longer necessary and the adapter part may be used together with all common stops. The door opening system is thus usable more flexibly. Simultaneously, the lock latch is guided securely on the lock latch guide, so that jamming or hooking is avoided. Furthermore, a door opener system results which is usable extremely variably and may be adapted flexibly to the existing installation conditions. The various system components may be combined with one another as a function of the predefined mounting position. The door opener system which is correct for the existing situation may thus be assembled without further measures from the individual components. Due to this modular construction and the compatibility with standard components, the warehousing costs are reduced and the door opener systems are usable cost-effectively with greatly varying locks, door profiles, etc. Furthermore, the distance between lock latch engagement point and the outer visible edge of the door opener system is minimized.

The adapter part is supported on the door opener and is covered on its top side by the striker plate. Because the lock latch guide runs without interruptions or recesses as a diagonal plane over the entire stop width and thus also over the entire latch width, a closed construction of the door opener system results, which is visually advantageous.

A latch opening is typically provided in the striker plate, through which the lock latch may engage in the pivot latch. Furthermore, this latch opening is expediently enclosed on all sides by the striker plate, i.e., the opening is implemented so that it adjoins the striker plate on every side in relation to the striker plate plane. The striker plate is thus implemented as closed to the outside. A higher basic strength of the striker plate thus results. In such an embodiment of the striker plate, it is also preferable to situate the lock latch guide between the door-side inner edge of the latch opening and the pivot latch. The lock latch guide is to be situated so that it presses against both the inner edge and also the pivot latch. The distance between latch engagement point and outer visible edge is thus minimized further and it is ensured that the lock latch slides along the slide face and out of the latch opening after being released and thus comes out of the striker plate without previously getting stuck or jamming.

The lock latch is expediently implemented so that it its upper area terminates essentially flush with the surface of the striker plate. A visually closed embodiment of the door opener system thus results. Furthermore, the lock latch thus slides especially easily out of the striker plate or out of the door opener system. In this embodiment, the lock latch guide thus projects out of the adapter part essentially by the amount of the striker plate thickness. A further advantage of this embodiment is that in the case of a latch opening open toward the door side, the lock latch guide may close this opening, so that a closed implementation of the door opener system nonetheless results overall. Alternatively, the lock latch guide may also have its upper area press flush against the bottom of the striker plate. It is advantageous in this case that the adapter part or its lock latch guide may be implemented having a relatively large width and nonetheless may be used with striker plates having narrower latch openings or having narrower stop widths.

The adapter part is preferably implemented in such a way that the side of the door opener system facing toward the door is covered to the outside in every position of the pivot latch. This may be achieved, for example, by implementing the diagonal plane of the lock latch guide projecting sufficiently far downward that the interior of the pivot latch is always covered by the lock latch guide even in the completely pivoted state. It is advantageous in this case that the entry of dirt, dust, or similar material into the door opener is thus avoided or reduced.

In order to simplify the production of the door opener system further, it is preferable to implement the adapter part and the lock latch guide in one piece.

In a preferred embodiment of the present invention, in addition to the lock latch guide, at least one blocking latch guide is provided to guide a blocking latch on the adapter part in addition to the lock latch guide. Blocking latches are provided like lock latches on the door or on the door lock and are displaceable into the interior of the door against a spring force. They are frequently situated directly next to the lock latch, viewed in the longitudinal direction of the lock latch. The purpose of the blocking latches is to block the lock latch when it engages in the pivot latch and engages behind the stop. Attempts at manipulation, which are intended to displace the lock latch from the outside into the interior of the door against the spring force, in order to thus open the non-released door, thus fail. The blocking latch blocks the lock latch when it is pressed into the door against the spring force. The door opener system is implemented in such a way that when the lock latch is in the engaged position, the blocking latch presses against the adapter part or the striker plate in such a way that it is retracted into the door or the door lock. The lock latch is thus blocked. If the pivot latch is now released and the door pivots easily out of the engaged position, the adapter part is implemented in such a way that there is sufficient space available for the blocking latch so that it may again be pushed out of the door or the door lock by the spring force and the lock latch is thus released. The lock latch may slide along the lock latch guide and may be displaced thereby against the spring force. In order to ensure that the extended blocking latch does not hook or become stuck on the door opener or striker plate as it pivots out of the door opener, it is expedient also to provide a guide for the blocking latch, along which it may slide as it runs out of the door opener. It is advantageous also to implement this blocking latch guide on the adapter part, since the adapter part is thus also usable for door opener systems having a blocking latch, without blocking latch guides having to be provided separately for this purpose. The possible uses of the door opener systems are thus increased further and the flexibility of the usability is improved further overall.

The at least one blocking latch is expediently implemented as essentially V-shaped. The blocking latch guide is thus implemented as trough-like and has two diagonal slide faces, the door-side slide face running into the door opener and the diametrically opposite slide face running out of the door opener. Secure sliding of the blocking latch into the door opener, further to the blocking position, and back out of the door opener is thus ensured.

Furthermore, it is preferable to situate the at least one blocking latch guide at one end of the lock latch guide. One end here means one of the ends of the lock latch guide which adjoin the lock latch guide in the axial direction. A blocking latch guide is especially preferably provided at both ends of the lock latch guide. The adapter part may thus be used for door opener systems which are to be installed on the left side of the frame and also on the right side of the frame.

In order to ensure secure and slip-free mounting of the adapter part between striker plate and door opener, it is expedient to provide fasteners, using which the adapter part may be attached between striker plate and door opener. Longitudinal holes are preferably provided on the adapter part as fasteners. The adapter part may be screwed together with striker plate and door opener through the longitudinal holes. The implementation of the fasteners as longitudinal holes has the advantage that the adapter part may also be used with various striker plates and door openers of different sizes, since the different dimensions may be compensated for through the play of the longitudinal holes.

Furthermore, it is expedient to provide positioning means, using which the adapter part is positionable in the particular intended position on the door opener. It is thus ensured that the adapter part is always located in the correct position for every door opener. The positioning means are preferably implemented as a catch which is provided on the bottom side of the adapter part and engages in corresponding projections which are in turn implemented on the door opener.

The door opener system may also comprise multiple adapter parts, the various adapter parts each being implemented having different dimensions and being alternately usable between door opener and striker plate. This is advantageous especially when the door opener system is to be usable with so many different types of door openers and striker plates that an adapter part may no longer be adapted for all different embodiments.

Furthermore, the object is achieved by an adapter part according to claim 13.

In the following, the present invention is described further on the basis of exemplary embodiments illustrated in the drawing.

Figure 3:
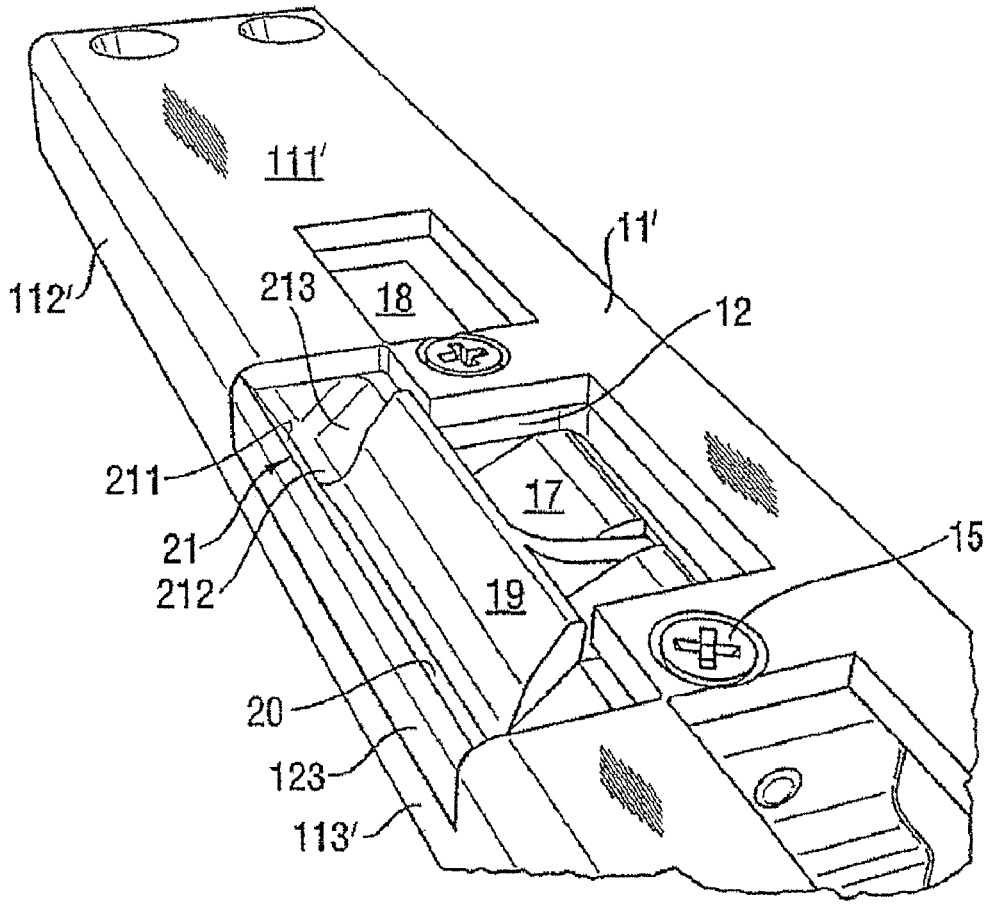
Figure 4:
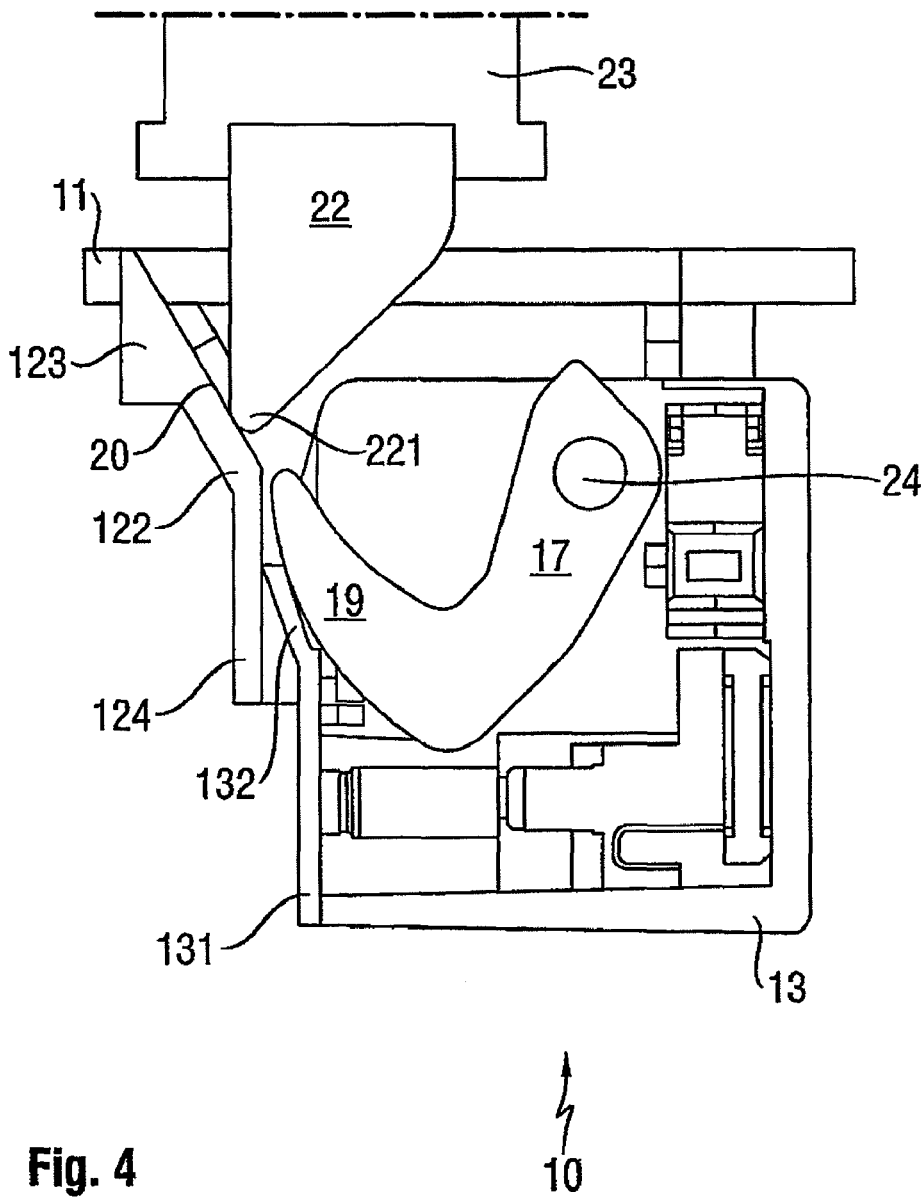
Figure 5:
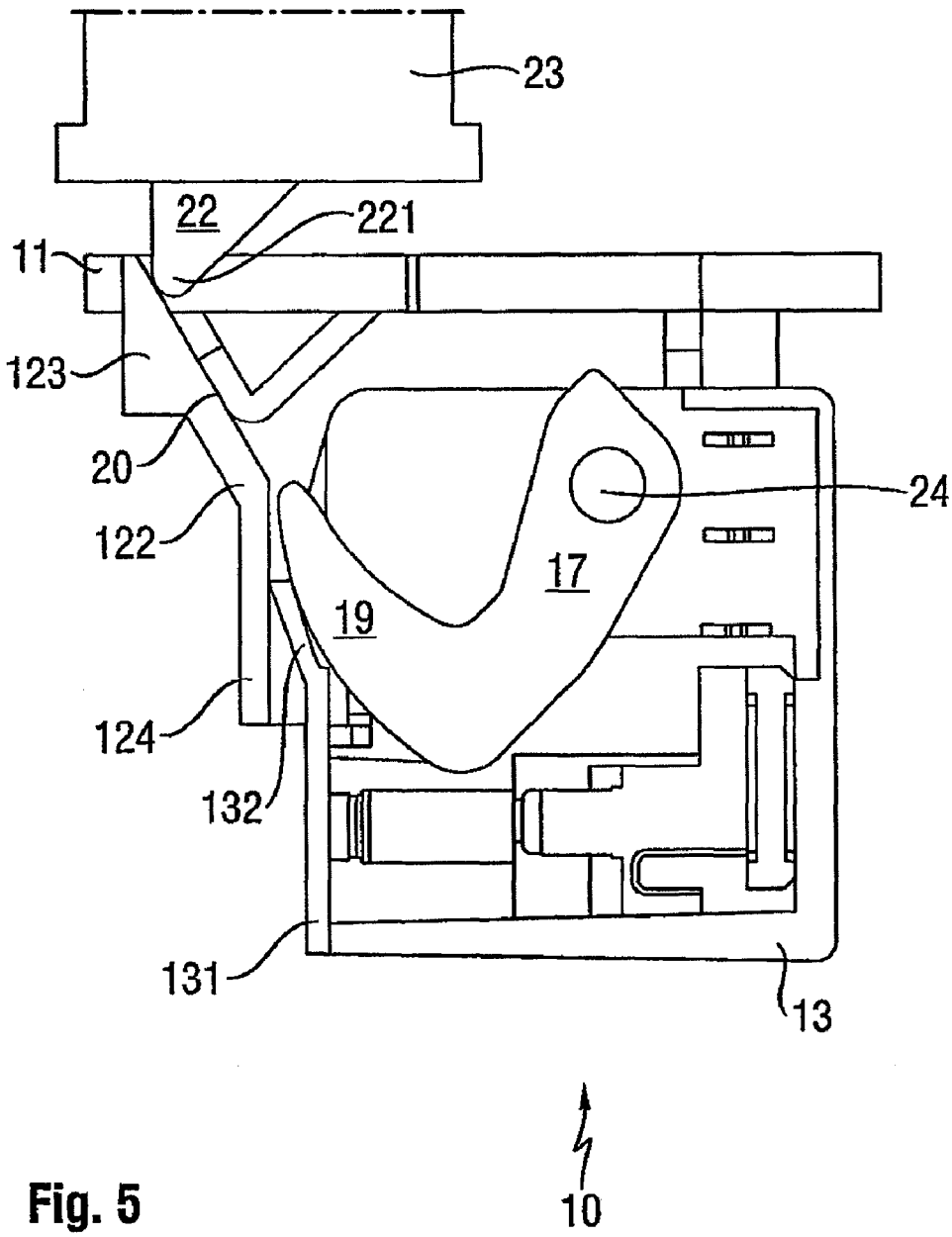
Figure 6:
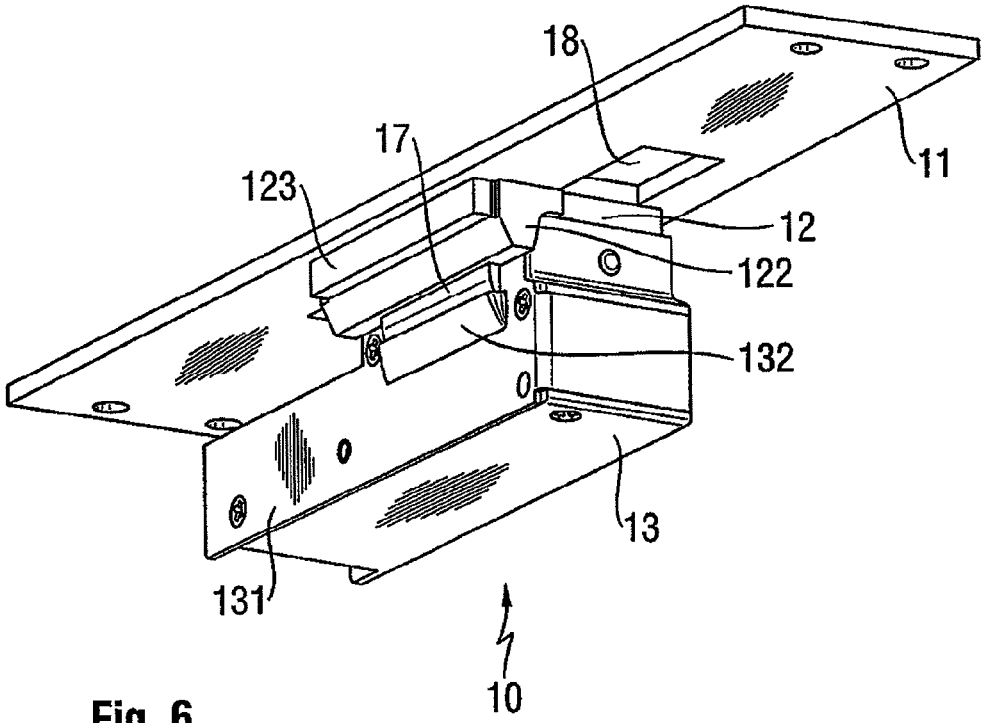
Figure 7:
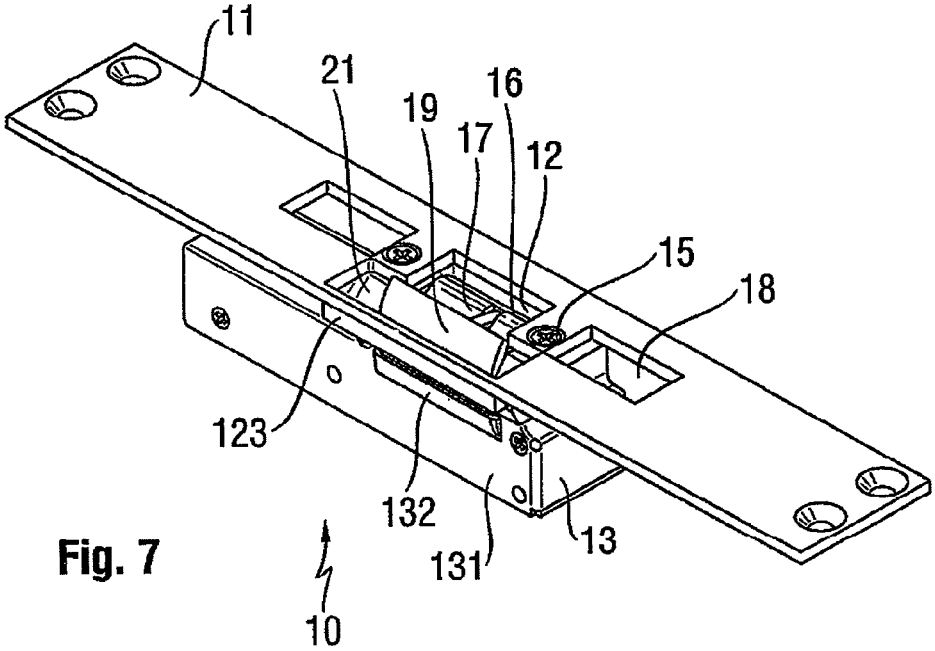
Figure 8:
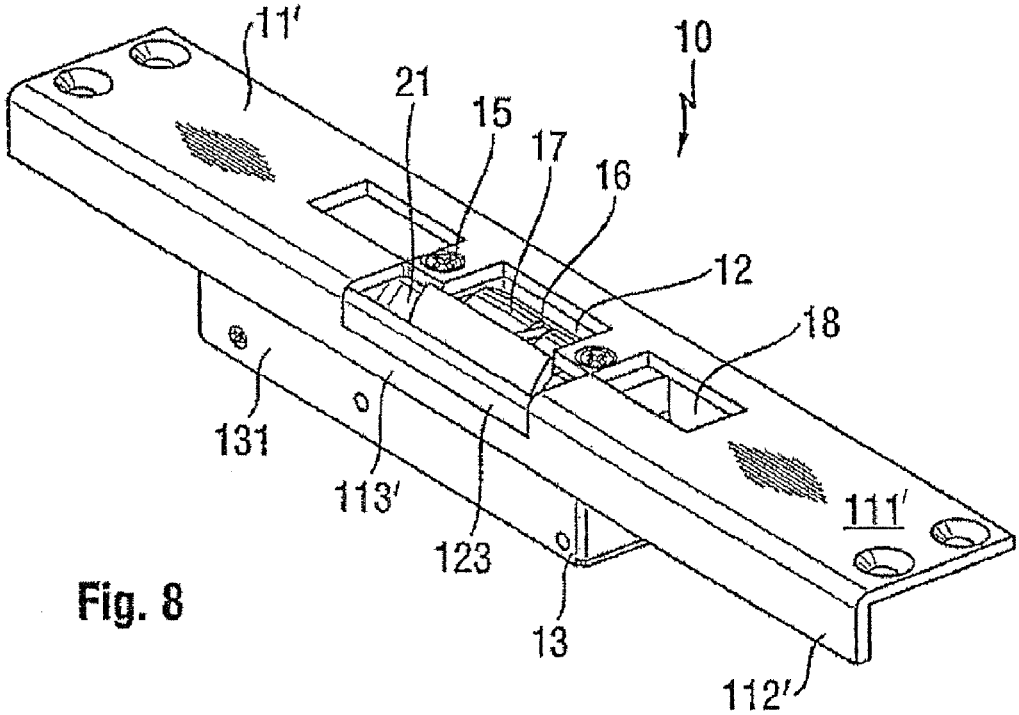
Figure 9:
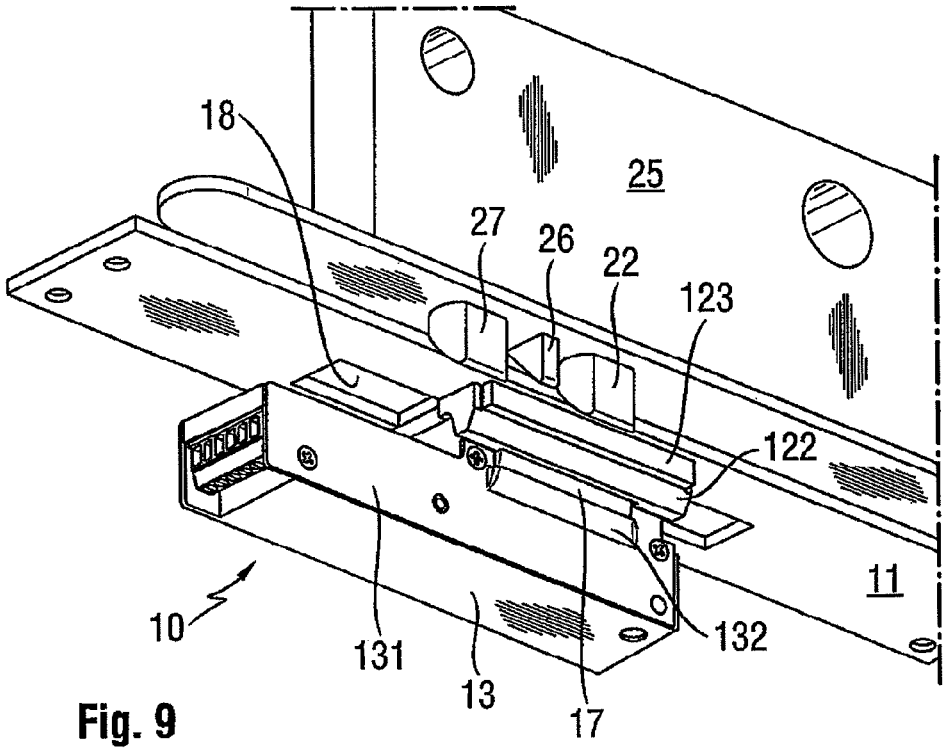
Figure 10:
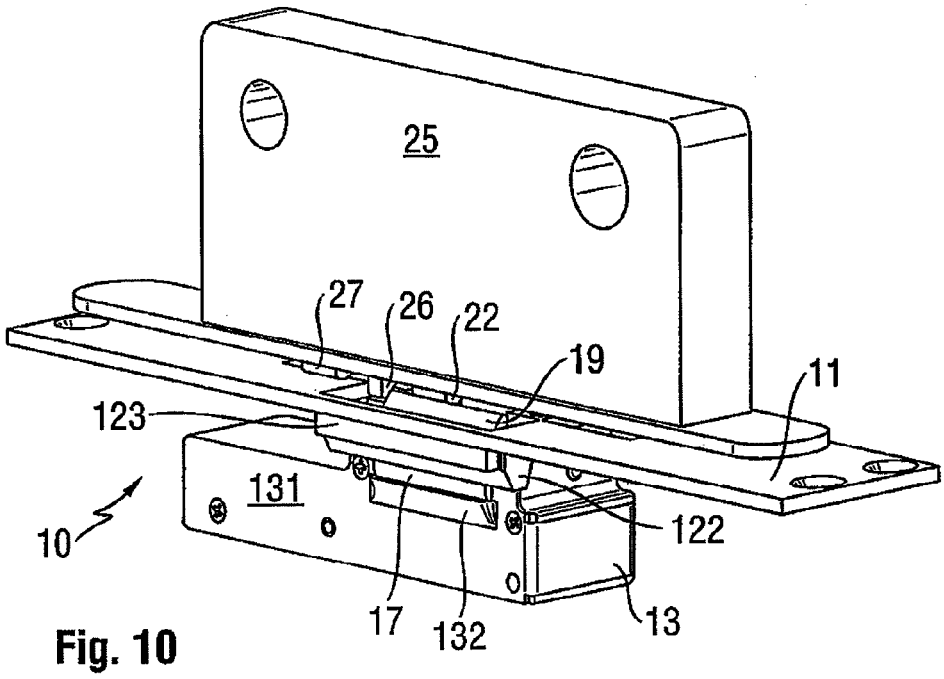
Figure 11:
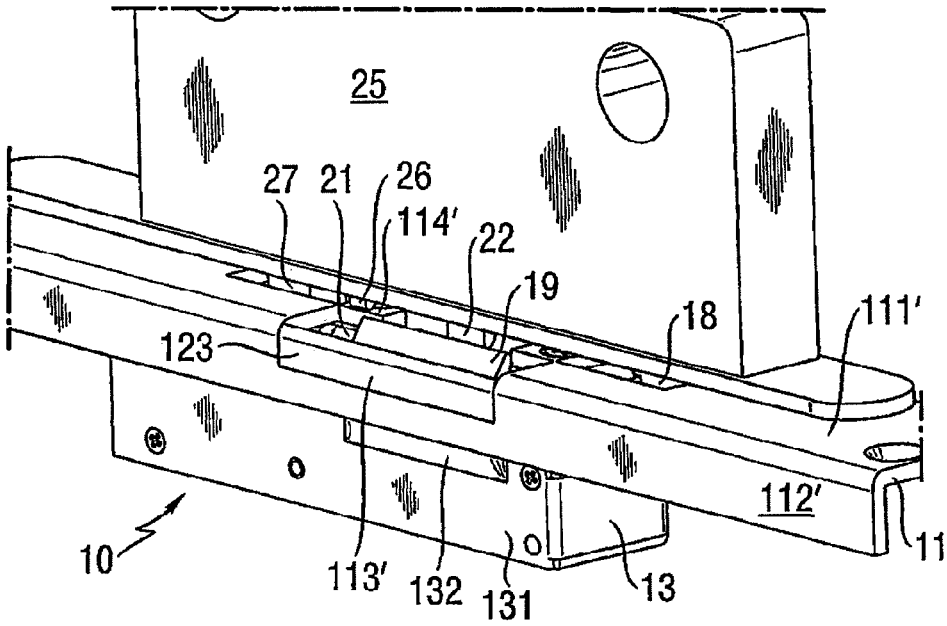
Figure 12:
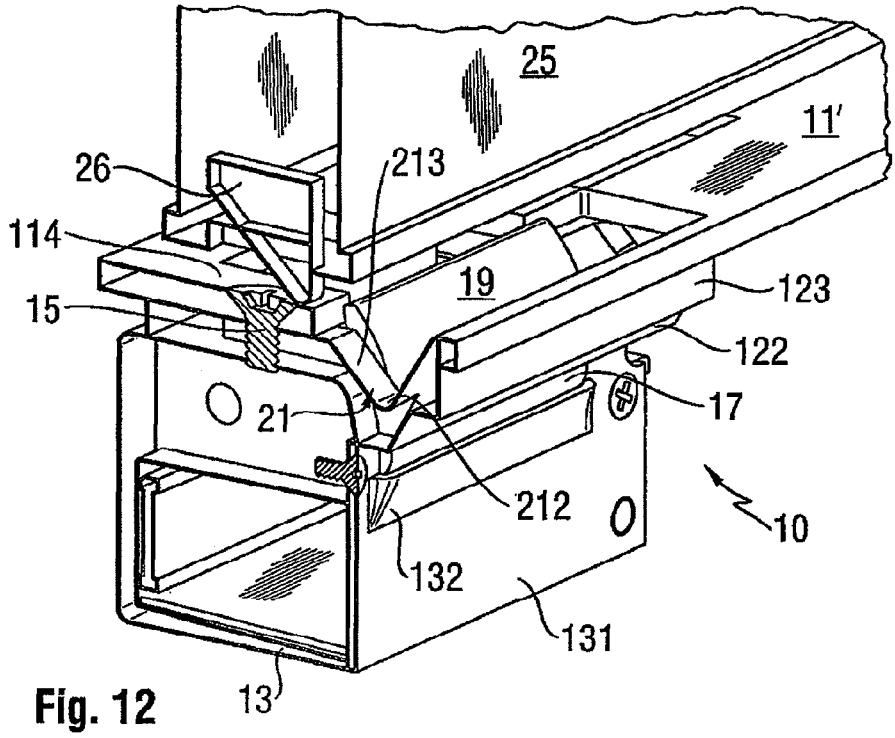
Figure 13:
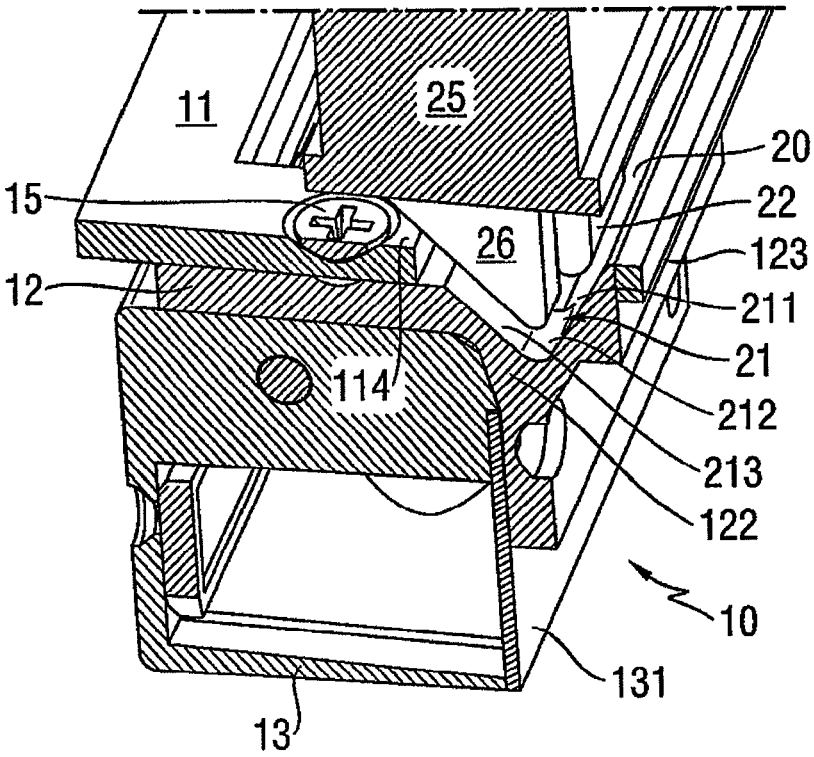
Figure 14:
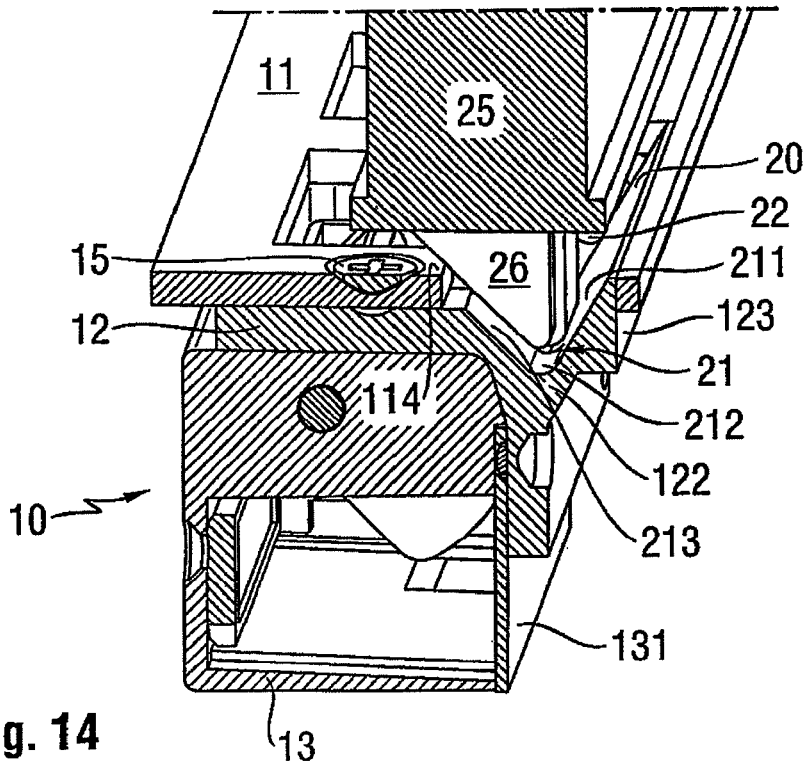

FIG. 1 schematically shows a perspective exploded view of a door opener system having flat striker plate, adapter part, and door opener;

FIG. 2 schematically shows a perspective exploded view of a door opener system having angled striker plate, adapter part, and door opener;

FIG. 3 schematically shows a perspective view of a partial area of the door opener system from FIG. 2 in the assembled state;

FIG. 4 schematically shows a cross-sectional view of the door opener system having pivoted pivot latch and lock latch pressing against the lock latch guide;

FIG. 5 schematically shows the view from FIG. 4 having lock latch retracted further;

FIG. 6 schematically shows a perspective view of the lower area of the door opener system having flat striker plate, adapter part, and door opener;

FIG. 7 schematically shows a perspective view of the upper area of the door opener from FIG. 6;

FIG. 8 schematically shows the view from FIG. 7, the striker plate being implemented as an angled striker plate;

FIG. 9 schematically shows a perspective view of a door opener system and a door lock having lock latch and blocking latch;

FIG. 10 schematically shows the view from FIG. 9, the lock latch standing shortly before engaging in the pivot latch;

FIG. 11 schematically shows the view from FIGS. 9 and 10, the lock latch engaging in the pivot latch and the striker plate being implemented as an angled striker plate;

FIG. 12 schematically shows a perspective sectional view of a door opener system having a flat striker plate, in which the blocking latch is retracted and the lock latch is blocked;

FIG. 13 schematically shows a perspective sectional view of a door opener system having extended blocking latch and lock latch pressing against the lock latch guide; and FIG. 14 schematically shows a perspective sectional view of the door opener system from FIG. 13, the blocking latch pressing against the blocking latch guide and the lock latch being retracted further.

In the various embodiments described in the following, identical components in the figures are provided with identical reference numerals.

FIG. 1 shows a perspective exploded view of a door opener system 10. FIG. 7 also shows a perspective view of the same door opener system 10 in the assembled state. The door opener system 10 is constructed modularly and comprises a flat striker plate 11, an adapter part 12, and a door opener 13. The adapter part 12 is situated between the door opener 13 and the striker plate 11. In all three components cited of the door opener system 10, two screw holes 14 are provided, which lie one on top of another in the assembled state of the door opener system, so that screws 15 may be inserted therein to connect the individual components of the door opener system 10 to one another solidly.

The striker plate 11 comprises a latch opening 16, through which a lock latch (see FIGS. 4 and 5 as well as 9 through 11) may engage in the door opener latch 17, which is pivotable inward into the door opener 13. The latch opening 16, viewed in the striker plate plane, is enclosed on all sides by the striker plate 11. A rectangular bolt opening 18 is provided in the longitudinal direction of the striker plate 11 in each case above and below the latch opening 16, through which a door bolt or a similar part may engage in the door opener system 10. The bolt openings 18 are implemented and situated symmetrically to one another, so that the striker plate 11 or the entire door opener system 10 may be mounted both on the left and also the right of the frame.

The door opener 13 comprises a pivot latch 17, on which a stop 19 is implemented. The stop 19 projects upward on the door-side side of the door opener 13 from the pivot latch 17 and runs over the entire width of the pivot latch 17. In addition, the stop 19 is implemented continuously, i.e., without recesses, openings, or similar features. The adapter part 12 may be placed on the door opener 13 and is mounted thereon. The basic shape of the adapter part 12 is based on an approximately rectangular frame, in whose middle an also approximately rectangular opening 121 is provided, which essentially corresponds to the dimensions of the pivot latch 17. The adapter part 12 is implemented to rest on the door opener 13 in such a way that the bottom side of the adapter part 12 rests flush on the door opener 13 and the pivot latch 17 may pivot freely and is free for a lock latch to engage.

A trough 122, which extends in the longitudinal direction of the adapter part 12 from one side to the other end, projects slightly on each side from the adapter part 12 at the outer edge of the narrow sides of the adapter part 12, is implemented on the door-side area of the adapter part 12, which presses against the stop 19 of the pivot latch 17 from the outside in the installed state. On the top, the trough 122 terminates flush with the adapter part 12 and projects downward therefrom. A web 123, which is also continuous over the entire length of the adapter part 12, is implemented projecting from the trough 122 on the door-side outer edge of the adapter part 12. This web 123 projects slightly beyond the adapter part 12 on top and forms the terminus of the adapter part 12 on its door-side edge.

The lock latch guide 20 is provided on the interior of the web 123 and the trough 122, which is implemented as a slanted plane running diagonally inward to the opening 121 (see FIGS. 3 through 5). The length of the lock latch guide 20 essentially corresponds to the length of the opening 121 and thus also the length of the pivot latch 17 as well as the stop 19. It runs from the uppermost point of the web 123 to the lowermost point of the trough 122. The trough 122 has a bevel toward only one side in the area of the opening 121, which forms a part of the lock latch guide 20, i.e., it is open toward the opening 121. In contrast, in its end areas, i.e., in those areas of the trough 122 which project beyond the opening 121 of the adapter part 12 and the longitudinal direction, the trough 122 has a diagonal plane on two sides. One slanted plane is an extension of the lock latch guide 20 and accordingly runs from top to bottom in the direction of the opening 121. A further diagonal plane, which leads out of the trough 122, is opposite this diagonal plane (see FIGS. 3, 12, and 13). These areas of the trough 122 each form a blocking latch guide 21. The blocking latch guides 21 thus each adjoin one end of the lock latch guide 20, viewed in the longitudinal direction.

Normally, in known door locks having a blocking latch function, only one blocking latch is provided in addition to a lock latch (see FIGS. 9 through 11). Therefore, normally only one of the blocking latch guides 21 is required for guiding a blocking latch. The implementation of two blocking latch guides 21 at each end of the lock latch 20 has the advantage, however, that the adapter part 20 or the entire door opener system 10 may be installed both on the left and also the right of the frame.

FIG. 2 shows a perspective exploded view of a further embodiment of a door opener system 10, which is similar to that from FIG. 1. The same embodiment is shown in the assembled state in FIG. 8. The difference to the embodiment from FIG. 1 is that the striker plate 11' is implemented as an angled striker plate. Therefore, a web 112' extends essentially perpendicularly from the flat upper part 111' downward at the door-side edge. The web 112' is narrower in the area of the latch opening 16 than in its remaining area. The lower edge of the web 112' is implemented as continuous and linear over the entire length. The distance between the narrowed web area 113' and the upper part 111' approximately corresponds to the level of the web 123 projecting on the door side from the adapter part 12. This web 123 is thus implemented so that it rests on the narrower web part 113' of the striker plate 11' in the installed state and terminates essentially flush with the surface of the upper part 111' of the striker plate 11' (see FIG. 8). A visually closed implementation of the angled striker plate 11' thus results.

FIG. 3 shows a perspective view of a partial area of a door opener system 10 having an angled striker plate 11'. The adapter part 12 is introduced into the striker plate 11', the web 123 of the adapter part 12 resting on the narrow area 113' of the web 112' of the angled plate 11'. The adapter part 12 is situated so that it terminates flush with the web 112'. A blocking latch guide 21 is recognizable next to the lock latch guide viewed in the longitudinal direction. The door-side bevel 211 of the blocking latch guide 21 is an extension of the lock latch guide 20 in the longitudinal direction of the door opener system. It leads into the door opener system 10 up to a floor area 212 of the blocking latch guide 21. A further slanted plane 213, which is situated diametrically opposite the first slanted plane 211, leads back out of the floor area 212 from the door opener system 10, up to the upper edge of the adapter part 12. The second blocking latch guide at the other end of the lock latch guide 20 is implemented symmetrically to the first blocking latch guide 21 (see FIG. 2).

FIGS. 4 and 5 each show a cross-sectional view of the same door opener system 10. In both door opener systems 10, a lock latch 22 of a door 23 engages in the door system 10. The pivot latch 17 is located in each case in the pivoted state, i.e., it is pivoted into the interior of the door opener 13 around the pivot axis 24. The lock latch 22 retained by the pivot latch 17 is thus released and the door 23 is now freely pivotable and may be opened. During the opening procedure, the lock latch 22 stops in the area of its tip 221 at the lower end of the lock latch guide 20 and slides along it in the further course of the opening procedure. It is pressed against a spring force into the interior of the door 23 (see FIG. 5). After reaching the upper point of the lock latch guide 20, it slides over the surface of the door-side web of the striker plate 11 until it finally leaves the door opener system entirely and is again pressed by the spring force out of the door 23. The adapter part 12, including the lock latch guide 20 from FIGS. 4 and 5, is similar to that shown in FIGS. 1 through 3. In contrast thereto, a web 124, which projects perpendicularly downward, adjoins the trough 122. The web 124 is drawn downward far enough that it overlaps an area 132 of the door opener cover 131 projecting diagonally outward. The area 132 projects diagonally outward in order to provide the pivot latch 17 with enough space to pivot. The lock latch guide 20 is implemented as a continuous, slanted plane which extends over both the interior of the web 123 and also the interior of the trough 122. The upper area of the web 123 is situated so that it terminates flush with the surface of the striker plate 11.

FIG. 6 shows a perspective view of the front, lower area of a door opener system 10. An area 132, which approximately corresponds to the width of the pivot latch 17 and covers the lower area of the pivot latch 17, projects outward and diagonally upward from the door opener cover 131. This area 132 is implemented as an apron. The upper area of the pivot latch 17 or its stop 19 is covered by the trough 122 or by the web 123 of the adapter part 12. A middle area of the pivot latch 17 is uncovered to the outside. A closed system of the door opener system thus results overall, so that no dirt, dust, or similar material may enter in the door opener system 10 from the sides or from below. Even if the pivot latch 17 was pivoted completely into the door opener 13, the trough 122 is implemented as drawn downward far enough that the upper area of the stop 19 is still within the trough 122, so that a closed system is ensured at all times. This closed implementation is also visually desirable.

FIGS. 9 through 11 show perspective views of a door opener system working together with a door lock 25. The door opener system 10 in FIGS. 9 and 10 is provided with a flat striker plate 11, in contrast, the door opener system 10 in FIG. 11 is provided with an angled striker plate 11'. The lock 25 is a "Scandinavian lock" having a total of three latches. The right latch is a lock latch 22, which is implemented to engage in the door opener 13. Neighboring it on the left, a narrower blocking latch 26 is provided, which is implemented to block the lock latch 22 when the lock latch 22 is pivoted completely into the door opener 13 and engages behind the stop of the pivot latch. Neighboring the blocking latch 26 on the left, a further latch 27 is implemented, which assumes the bolt function for the door lock 25 and is implemented to engage in a bolt opening 18 provided in the striker plates 11, 11'.

The illustration in FIG. 9 shows the lock 25 shortly before entering the door opener system 10. The blocking latch 26 locks the lock latch as soon as the blocking latch 26 is pressed completely against a spring force into the lock 25 up to a switching point. The blocking latch 26 is situated somewhat recessed in relation to the lock latch 22 in the movement direction of the lock 25, so that the lock latch 22 is not yet locked by the blocking latch 26 during the insertion procedure.

In the illustration in FIG. 10, the door lock is shown shortly before reaching its final position, i.e., the lock latch 22 presses against the upper area of the stop 19 from the outside. The blocking latch 26 presses against the upper area of the diagonal plane 213 of the blocking latch guide 21. The latch 27 is also shown shortly before engaging in the bolt opening 18.

In the illustration shown in FIG. 11, the lock 25 is in its final position, i.e., the lock 25 is locked. The lock latch 22 engages behind the stop 19 and the latch 27 engages in the bolt opening 18. The blocking latch 27 is seated on a contact surface 114' of the striker plate 11' and is pressed far enough into the door lock 25 that the switching point is reached and the blocking latch 26 blocks the lock latch 22. The lock latch 22 may thus be displaced no further against the spring force of the lock 25, not even by attempts at manipulation from the outside.

FIG. 12 shows a perspective sectional illustration of a door opener system 10 having a flat striker plate 11 in the locked state. The blocking latch 26 rests on the contact surface 114 of the striker plate 11 and locks the lock latch 22.

FIGS. 13 and 14 show further perspective sectional illustrations of a door opener system 10 having a flat striker plate 11, which is in the released state. In the illustration shown in FIG. 13, the blocking latch 26 is extended completely and is located inside the area delimited by the V-shaped blocking latch guide 21, but does not press against it. The lock latch 22 is situated offset forward in the opening direction in relation to the blocking latch 26 and thus already presses against the lock latch guide 20 and is pushed thereby into the interior of the door lock 25. This offset arrangement of blocking latch 26 and lock latch 22 avoids having the lock latch 22 be blocked by the blocking latch 26 upon opening until it is extended far enough that it may slide out of the door opener system 10 over the striker plate 11. In the illustration from FIG. 14, the tip of the blocking latch 26 presses against the diagonal slide bevel 211 of the blocking latch guide 21. The lock latch 22 is retracted further into the door lock 25 than in the illustration from FIG. 13.

The invention claimed is:

1. A door opener system having a door opener configured to cooperate with a lock latch coupled to a door, the door opener system comprising:

a pivot latch moveable between a first position wherein the lock latch is retained by the pivot latch when the door is in a closed position, and a second position wherein the pivot latch is pivoted into the door opener to release the lock latch and allow the door to be moved to an open position, the pivot latch having a stop;

a striker plate configured to receive the lock latch;

an adapter part which is situated between the door opener and the striker plate, the adapter part having a lock latch guide which runs diagonally inward toward the door opener and being configured and positioned to contact and guide the lock latch out of the door opener when the door is moved to the open position after the pivot latch is pivoted to the second position;

wherein the lock latch guide comprises a sliding face which extends continuously over an entire width of the stop without extending through the stop and is situated on a door side adjacent the stop of the pivot latch, and further wherein the sliding face is configured and positioned to contact the lock latch after moving the pivot latch toward the second position.

2. The door opener system according to claim 1, wherein the lock latch guide is situated and implemented so that it terminates flush with the surface of the striker plate.

3. The door opener system according to claim 1, wherein the adapter part is implemented in such a way that the door-side side of the door opener system is covered to the outside in every position of the pivot latch.

4. The door opener system according to claim 1, wherein the adapter part and the lock latch guide are implemented in one piece.

5. The door opener system according to claim 1, wherein at least one blocking latch guide is provided on the adapter part for guiding a blocking latch.

6. The door opener system according to claim 5, wherein said at least one blocking latch guide is essentially V-shaped and comprises a slide face running diagonally into the door opener and a slide face running diagonally out of the door opener.

7. The door opener system according to claim 5, wherein said at least one blocking latch guide is provided on either end of the lock latch guide in the axial direction of the lock latch guide.

8. The door opener system according to claim 6, wherein said at least one blocking latch guide is provided on either end of the lock latch guide in the axial direction of the lock latch guide.

9. The door opener system according to claim 1, wherein longitudinal holes, are provided on the adapter part, to attach the adapter part between striker plate and door opener.

10. The door opener system according to claim 1, wherein the door opener system comprises multiple adapter parts, each having different dimensions, which are alternately usable between striker plate and door opener.

11. The door opener system according to claim 1, wherein the lock latch guide is situated and implemented so that it terminates flush with a surface of the striker plate.

12. An adapter part for use with a door opener system having a striker plate and a door opener configured to cooperate with a lock latch and a blocking latch coupled to a door, the door opener including a pivot latch moveable between a first position wherein the lock latch is retained by the pivot latch when the door is in a closed position, and a second position wherein the pivot latch is pivoted into the door opener to release the lock latch and allow the door to be moved to an open position, the adapter part comprising:

a lock latch guide provided on the adapter part configured and positioned to contact and guide the lock latch out of the door opener when the door is moved to the open position after the pivot latch is pivoted to the second position; and a blocking latch guide provided on either end of the lock latch guide in the axial direction of the lock latch guide and being configured and positioned to contact and guide the blocking latch out of the door opener when the door is moved to the open position after the pivot latch is pivoted to the second position;

wherein the adapter part is implemented to be inserted into the door opener system between the door opener and the striker plate.

13. A door opener system having a door opener configured to cooperate with a lock latch coupled to a door, the door opener system comprising:

a pivot latch moveable between a first position wherein the lock latch is retained by the pivot latch when the door is in a closed position, and a second position wherein the pivot latch is pivoted into the door opener to release the lock latch and allow the door to be moved to an open position, the pivot latch having a stop;

a striker plate configured to receive the lock latch;

an adapter part which is situated between the door opener and the striker plate, the adapter part having a lock latch guide which runs diagonally inward toward the door opener and being configured and positioned to contact and guide the lock latch out of the door opener when the door is moved to the open position after the pivot latch is pivoted to the second position;

wherein the lock latch guide comprises a sliding face which runs continuously over an entire width of the stop without extending through the stop and is situated on a door side adjacent the stop of the pivot latch, and further wherein the sliding face is configured and positioned to contact the lock latch after moving the pivot latch toward the second position; and a latch opening provided in the striker plate which is enclosed on all sides by the striker plate through which the lock latch is configured to engage the pivot latch, wherein the lock latch guide is situated between a door-side inner edge of the latch opening and the stop of the pivot latch.

* * * * *

UNITED STATES PATENT AND TRADEMARK OFFICE

CERTIFICATE OF CORRECTION

PATENT NO. : 7,900,981 B2
APPLICATION NO. : 11/544939
DATED : March 8, 2011
INVENTOR(S) : Oliver Hirschoff It is certified that error appears in the above-identified patent and that said Letters Patent is hereby corrected as shown below:

Column 3
Line 26, reads “so that it its” and should read -- so that its --.

Column 4
Line 46, reads “using which the adapter” and should read -- with which the adapter --.

Column 10
Line 2, Claim 9, reads “holes, are provided on” and should read -- holes are provided on --.

Signed and Sealed this
Eleventh Day of October, 2011

David J. Kappos

David J. Kappos
*Director of the United States Patent and Trademark Office*